US006162328A

United States Patent [19]

Cenisio et al.

[11] Patent Number: 6,162,328

[45] Date of Patent: Dec. 19, 2000

[54] METHOD FOR SURFACE SIZING PAPER WITH CELLULOSE REACTIVE AND CELLULOSE NON-REACTIVE SIZES, AND PAPER PREPARED THEREBY

[75] Inventors: Marco Franco Cenisio, Waterloo, Belgium; Edwin René Hensema, Wilmington, Del.; Andrew Mears, Kent, United Kingdom; Daniel Felix Varnell, Wilmington, Del.

[73] Assignee: Hercules Incorporated, Wilmington, Del.

[21] Appl. No.: 08/940,514

[22] Filed: Sep. 30, 1997

[51] Int. Cl.[7] ..... D21H 21/16; D21H 23/24

[52] U.S. Cl. ..... 162/135; 162/158; 162/164.1; 162/164.3; 162/179; 162/175; 162/181.1; 162/181.2; 162/168.4; 162/180

[58] Field of Search ..... 162/158, 164.1, 162/164.3, 179, 175, 180, 181.1, 181.2, 181.3, 168.4, 135, 183–184; 106/210, 213, 287.2; 428/530, 537.5

[56] References Cited

U.S. PATENT DOCUMENTS

| | | | |
|---|---|---|---|
| 2,790,735 | 4/1957 | McLaughin et al. | 117/155 |
| 3,242,121 | 3/1966 | Hill, Jr. | 260/29.6 |
| 3,297,614 | 1/1967 | Pueschner | 260/29.6 |
| 3,477,871 | 11/1969 | van Westrenen | 117/155 |
| 3,776,812 | 12/1973 | Jongetjes | 162/168 |
| 4,040,900 | 8/1977 | Mazzarella et al. | 162/158 |
| 4,121,966 | 10/1978 | Amano et al. | 162/164 |
| 4,207,142 | 6/1980 | Shepherd | 162/158 |
| 4,214,948 | 7/1980 | Mazzarella et al. | 162/158 |
| 4,222,820 | 9/1980 | Hiskens et al. | 162/158 |
| 4,265,978 | 5/1981 | Morishita et al. | 428/537 |
| 4,464,524 | 8/1984 | Karickhoff | 526/313 |
| 4,521,494 | 6/1985 | Mani | 428/514 |
| 4,721,655 | 1/1988 | Trzasko et al. | 428/530 |
| 4,859,720 | 8/1989 | Flesher et al. | 523/332 |
| 4,898,787 | 2/1990 | Min et al. | 428/480 |
| 4,919,724 | 4/1990 | Cenisio et al. | 106/199 |
| 5,116,924 | 5/1992 | Bung et al. | 526/312 |
| 5,169,886 | 12/1992 | Bung et al. | 524/238 |
| 5,200,036 | 4/1993 | Noda | 162/164.3 |
| 5,281,307 | 1/1994 | Smigo et al. | 162/164.3 |
| 5,397,436 | 3/1995 | Robeson et al. | 162/158 |
| 5,456,800 | 10/1995 | Tansley et al. | 162/158 |
| 5,498,648 | 3/1996 | de Clercq et al. | 524/47 |
| 5,510,003 | 4/1996 | Colasurdo et al. | 162/158 |
| 5,595,631 | 1/1997 | Tsai et al. | 162/175 |
| 5,626,719 | 5/1997 | Tansley et al. | 162/158 |
| 5,685,815 | 11/1997 | Bottorff et al. | 493/186 |
| 5,725,731 | 3/1998 | Brungardt et al. | 162/72 |
| 5,766,417 | 6/1998 | Brungardt | 162/158 |
| 5,846,663 | 12/1998 | Brungardt et al. | 428/537.5 |
| 5,853,542 | 12/1998 | Bottorff | 162/168.2 |

FOREIGN PATENT DOCUMENTS

| | | |
|---|---|---|
| 0141641B1 | 5/1985 | European Pat. Off. . |
| 0629741A1 | 12/1994 | European Pat. Off. . |
| 0666368A2 | 8/1995 | European Pat. Off. . |
| 0831177A2 | 3/1998 | European Pat. Off. . |
| 58-149398A | 9/1983 | Japan . |
| 59-053799A | 3/1984 | Japan . |
| 60-91068158B | 9/1985 | Japan . |
| 5-247888A | 9/1993 | Japan . |
| 6-073793A | 3/1994 | Japan . |
| 9-228293 | 9/1997 | Japan . |
| WO 97/30218 | 8/1997 | WIPO . |
| WO 97/37079 | 10/1997 | WIPO . |
| WO 97/41186 | 11/1997 | WIPO . |
| WO 98/32920 | 7/1998 | WIPO . |

OTHER PUBLICATIONS

C. F. Farley and R. B. Wasser, "The Sizing of Paper, Second Edition," edited by W. F. Reynolds, Tappi Press, 1989, pp. 51–62.

E. Strazdins in "The Sizing of Paper, Second Edition," edited by W. F. Reynolds, Tappi Press, 1989, pp. 1–31.

"Pulp and Paper Chemistry and Chemical Technology," J.P. Casey, 3rd Ed. vol. 3, pp. 1553–1554.

TAPPI Standard T530.

"Paper Acceptance Criteria for Hewlett–Packard DeskJet 500C, 550C & 560 Printers," 1994, pp. 1–32.

*Primary Examiner*—Stanley S. Silverman
*Assistant Examiner*—José A. Fortuna
*Attorney, Agent, or Firm*—Gary A. Samuels; Martin F. Sloan

[57] ABSTRACT

There is disclosed a method for sizing paper by adding to the surface of the paper a sizing composition comprising cellulose reactive and cellulose non-reactive size. The sized paper performs better in ink jet printing than does paper that is the same except that the size composition contains only cellulose reactive size or only cellulose non-reactive size, when the printing is evaluated for at least one property selected from the group consisting of optical density, feathering, wicking, edge roughness and bleed. The sized paper also has higher toner adhesion, a higher coefficient of friction and a lower coefficient of friction bandwidth than does paper that is the same except that the size composition contains only cellulose reactive size. The paper is also capable of performing effectively in tests that measure its convertibility on state-of-the-art converting equipment and its performance on high speed end-use machinery.

77 Claims, No Drawings

METHOD FOR SURFACE SIZING PAPER WITH CELLULOSE REACTIVE AND CELLULOSE NON-REACTIVE SIZES, AND PAPER PREPARED THEREBY

FIELD OF THE INVENTION

This invention relates to processes for surface sizing paper, to paper prepared by the processes, and to processes for preparing surfaces sizes.

BACKGROUND OF THE INVENTION

Current applications for fine paper require particular attention to sizing before conversion or end-use, such as high speed photocopies, envelopes, forms bond, including computer paper, and adding machine paper. Paper is conventionally sized by addition of sizing agents to the "wet end" of the paper process (internal addition), i.e., to the pulp before sheet formation, or by addition of sizing agents to the surface of already formed paper sheet that has been at least partially dried (surface sizing).

Alkyl ketene dimers (AKD's) and alkenylsuccinic anhydrides are widely used paper sizing agents. Although they are described in the literature as being useful for both internal and surface sizing, they are generally not used for surface sizing commercially. Cellulose reactive sizes, such as ketene dimers and alkenylsuccinic anhydrides display high sizing efficiency, but may cause problems in size reversion, toner adhesion and high speed paper converting. Variable coefficient of friction is at least one factor leading to the problems in high speed converting operations.

Recently alkenyl ketene dimers and ketene multimers have been described that are useful for internal and surface sizing and that overcome the deficiencies in high speed converting. These materials are disclosed in U.S. Pat. No. 5,846,663, which is incorporated herein by reference in its entirety, and in European Patent Application No. 0,666,368 A3, which corresponds to commonly owned U.S. Pat. No. 5,685,815, which is incorporated herein by reference in its entirety. Precis®2000 and Precis®3000 sizing agents (available from Hercules Incorporated, Wilmington, Del.) are examples of such sizes. They are widely used commercially for internal sizing, but not for surface sizing because they do not contribute to good toner adhesion and other surface properties.

Cellulose non-reactive sizes have been used for some time as surface sizes. Examples of such materials are starch and other polymeric sizes such as copolymers of styrene with vinyl monomers such as maleic anhydride, acrylic acid and its alkyl esters, acrylamide, etc. In particular, styrene/maleic anhydride resins are widely used for surface sizing. Cellulose non-reactive sizes generally exhibit improved toner adhesion, little or no effect on coefficient of friction, no effect, or an improved effect on high speed converting, and no size reversion when compared to reactive sizes; however, they are less efficient at sizing than the reactive sizes.

As a result of all of the above, most papers at the present time are internally sized with alkenylsuccinic anhydride, alkyl ketene dimers, alkenyl ketene dimers or rosin sizes.

There is a need to provide surface sizing agents that overcome the problems enumerated above, because there are substantial advantages to be gained from surface sizing when compared to internal sizing. Among them are:

a) Efficiency. The surface size components are completely retained in the system; whereas in internal sizing a significant amount is lost in the white water. Moreover, in those applications where only a surface response is needed, surface sizing permits keeping the majority of the size at the surface, thus gaining the maximum response for a minimum amount of material.

b) Environmental. The high retention of surface size components minimizes environmental contamination.

c) Fiber bonding. Sizes applied at the surface are less likely to interfere with fiber-fiber bonding because the bonds have already been formed when the sizes are applied.

Now it has been found unexpectedly that treatment of paper with a combination of reactive and non-reactive sizes can produce paper with a unique balance of final properties that cannot be achieved by using either of the size types alone. The combination of cellulose reactive and cellulose non-reactive sizes provides paper that exhibits better water holdout than paper that is the same except that the sizing composition contains only cellulose non-reactive size. The combination size also provides paper that performs better in ink jet printing than does paper that is the same except that the size composition contains only cellulose reactive or only cellulose non-reactive size. Furthermore, the paper exhibits better toner adhesion, higher coefficient of friction and a lower coefficient of friction bandwidth than does paper that is the same except that the size composition contains only cellulose reactive size. The paper is also capable of performing effectively in tests that measure its convertibility on state-of-the-art converting equipment and its performance on high speed end-use machinery.

U.S. Pat. No. 5,498,648 discloses paper size mixtures which are prepared by mixing an aqueous suspension of a digested cationic starch with a finely divided, aqueous polymer dispersion which is the paper size and emulsifying $C_{14}$–$C_{22}$-alkyldiketene in this mixture at not less than 70° C. It is taught in the patent that the size mixtures can be used for both engine (internal) and surface sizing. However, use as a surface size is mentioned only as a possibility; all of the examples and discussion pertain to internal sizing.

SUMMARY OF THE INVENTION

In one embodiment of the invention a process for preparing sized paper comprises: a) providing an aqueous pulp suspension; b) sheeting and drying the aqueous pulp suspension to obtain paper; c) applying to at least one surface of the paper an aqueous size composition comprising at least one cellulose reactive size and at least one cellulose non-reactive size, wherein the cellulose non-reactive size is polymer of weight average molecular weight greater than about 1,500, and wherein the cellulose reactive size is not solid at 25° C.; and d) drying the paper.

In another embodiment, in step (c) the cellulose reactive size is applied at a level of about 0.005 to about 0.5 wt. % on a dry basis based on the dry weight of the paper. In another embodiment, in step (c) the cellulose non-reactive size is applied at a level of about 0.01 to about 0.5 wt. % on a dry basis based on the dry weight of the paper. In yet another embodiment in step (c) the aqueous size composition is applied at a level that applies about 0.01 to about 1 wt. % total of cellulose reactive and cellulose non-reactive size on a dry basis based on the dry weight of the paper.

In yet another embodiment a process of preparing a surface size composition comprises: a) providing an aqueous dispersion of a cellulose reactive size and an aqueous dispersion of a cellulose non-reactive size, wherein the cellulose non-reactive size is polymer of molecular weight greater than about 1,500; and b) mixing the dispersions to obtain a surface size composition dispersion, wherein the surface size composition dispersion has a shelf life at room temperature of greater than 8 days.

DETAILED DESCRIPTION OF THE INVENTION

For the purpose of this disclosure "sizes" are defined as materials that provide upon addition to paper at a size press, in combination with a typical oxidized starch (e.g. D150 starch from Grain Processing Corporation, Muscatine, Iowa.), applied at a level of 4 wt. % on a dry basis based on dry paper weight, an increase of sizing as measured by the Hercules Sizing Test (HST) method over the same paper treated with only starch at the same 4% level. Specifically, for the purposes of this disclosure a material is a size if it meets at least one the following tests:

1) addition of surface sizing agent at a level of 0.15% on a dry basis based on dry paper weight, with starch, as noted above, to a 75 g/m$^2$ base sheet containing a 75/25 hardwood/softwood bleached pulp mixture refined to give a freeness of 425 CSF (Canadian Standard Freeness) and containing the following additives added at the wet-end of the paper machine: 15% precipitated calcium carbonate filler (Albacar® HO, available from Specialty Minerals Inc., Bethlehem, Pa.), 0.5% cationic starch (Sta-Lok®400 from Staley Manufacturing Co., Decatur, Ill.), and 0.05% of an alkyl ketene dimer internal sizing agent such as Hercon®70 (available from Hercules Incorporated, Wilmington, Del.), all percentages being on a dry active basis based on final dry paper weight. The sizing increase must be at least 20 seconds (average of at least 6 repetitions);

2) addition of surface sizing at a level of 0.25% on a dry basis based on the dry weight of paper, with starch as noted above to a 75 g/m$^2$ base sheet containing a 75/25 hardwood/softwood bleached pulp mixture refined to give a freeness of 425 CSF and containing the following additives added at the wet-end of the paper machine: 15% precipitated calcium carbonate filler (Albacar®HO), 0.5% cationic starch (Sta-Lok®400) and no internal sizing agent. All percentages being on a dry active basis based on final dry paper weight. The sizing increase must be at least 5 seconds (average of at least 6 repetitions).

The HST is described in TAPPI Standard T530, the disclosure of which is incorporated herein by reference.

Cellulose reactive sizes are defined as those sizes believed to be capable of forming covalent chemical bonds by reaction with the hydroxyl groups of cellulose, and cellulose non-reactive sizes are defined as those that do not form these covalent bonds with cellulose.

Cellulose reactive sizes for use in the invention include ketene dimers and multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

Ketene dimers and multimers are materials of formula 1, wherein n is an integer of 0 to about 20, R and R", which may be the same or different, are saturated or unsaturated straight chain or branched alkyl groups having 6 to 24 carbon atoms; and R' is a saturated or unsaturated straight chain or branched alkyl group having from about 2 to about 40 carbon atoms.

(1)

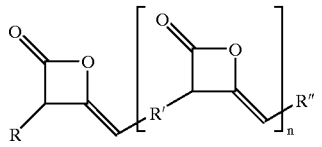

Ketene dimers for use in the process of this invention have the structure of formula 1 where n=0 and the R and R" groups, which can be the same or different, are hydrocarbon radicals. Preferably the R and R" groups are alkyl or alkenyl groups having 6 to 24 carbon atoms, cycloalkyl groups having at least 6 carbon atoms, aryl having at least 6 carbon atoms, aralkyl having at least 7 carbon atoms, alkaryl having at least 7 carbon atoms, and mixtures thereof. More preferably ketene dimer is selected from the group consisting of (a) octyl, decyl, dodecyl, tetradecyl, hexadecyl, octadecyl, eicosyl, docosyl, tetracosyl, phenyl, benzyl, β-naphthyl, and cyclohexyl ketene dimers, and (b) ketene dimers prepared from organic acids selected from the group consisting of montanic acid, naphthenic acid, 9,10-decylenic acid, 9,10-dodecylenic acid, palmitoleic acid, oleic acid, ricinoleic acid, linoleic acid, eleostearic acid, naturally occurring mixtures of fatty acids found in coconut oil, babassu oil, palm kernel oil, palm oil, olive oil, peanut oil, rape oil, beef tallow, lard, whale blubber, and mixtures of any of the above named fatty acids with each other. Most preferably ketene dimer is selected from the group consisting of octyl, decyl, dodecyl, tetradecyl, hexadecyl, octadecyl, eicosyl, docosyl, tetracosyl, phenyl, benzyl, β-naphthyl, and cyclohexyl ketene dimers.

Ketene dimers that are solid at 25° C. have been used commercially for many years and are prepared by dimerization of the alkyl ketenes made from saturated, straight chain fatty acid chlorides; the most widely used are prepared from palmitic and/or stearic acid. Aqueous dispersions of these materials are available as Hercon® paper sizing agents from Hercules Incorporated, Wilmington, Del.

Ketene multimers for use in the process of this invention are disclosed in commonly owned U.S. Pat. No. 5,846,663. They have the formula 1 where n is an integer of at least 1, R and R", which may be the same or different, are saturated or unsaturated straight chain or branched alkyl groups having 6 to 24 carbon atoms, preferably 10 to 20 carbon atoms, and more preferably 14 to 16 carbon atoms; and R' is a saturated or unsaturated straight chain or branched alkyl group having from 2 to 40 carbon atoms, preferably from 4 to 8 or from 28 to 40 carbon atoms.

Ketene multimers are described in: European Patent Application Publication No. 0,629,741 A1, European Patent Application Publication No. 0,666,368 A3, which corresponds to U.S. Pat. No. 5,685,815, which is incorporated herein by reference in its entirety, and in U.S. patent application Ser. No. 08/601,113, filed Feb. 16, 1996, which is incorporated herein by reference in its entirety.

A particularly preferred group of ketene dimers and multimers for use in the invention is those which are not solid at 25° C. (not substantially crystalline, semi-crystalline or waxy solid; i.e., they flow on heating without heat of fusion). More preferably they are not solid at 20° C. Even more preferably they are liquid at 25° C., and most preferably liquid at 20° C. These liquid dimers and multimers are mixtures of compounds of formula 1 in which n is preferably 0 to 6, more preferably 0 to 3, and most preferably 0; R and R", which can be the same or different, are saturated or unsaturated, straight chain or branched alkyl groups having 6 to 24 carbon atoms; R' is a saturated or unsaturated, straight chain or branched alkyl group having 2 to 40 carbon atoms, preferably 4 to 32 carbon atoms; and wherein at least 25% of the R and R" groups in the mixture of compounds is unsaturated.

The liquid ketene dimers and multimers may comprise a mixture of ketene dimer or multimer compounds that are the reaction product of a reaction mixture comprising unsaturated monocarboxylic fatty acids. The reaction mixture may further comprise saturated monocarboxylic fatty acids and dicarboxylic acids. Preferably the reaction mixture for preparing the mixture of dimer or multimer compounds comprises at least 25 wt % unsaturated monocarboxylic fatty acids, and more preferably at least 70 wt % unsaturated monocarboxylic fatty acids.

The unsaturated monocarboxylic fatty acids included in the reaction mixture preferably have 10–26 carbon atoms, more preferably 14–22 carbon atoms, and most preferably 16–18 carbon atoms. These acids include, for example, oleic, linoleic, dodecenoic, tetradecenoic (myristoleic), hexadecenoic (palmitoleic), octadecadienoic (linolelaidic), octadecatrienoic (linolenic), eicosenoic (gadoleic), eicosatetraenoic (arachidonic), cis-13-docosenoic (erucic), trans-1 3-docosenoic (brassidic), and docosapentaenoic (clupanodonic) acids, and their acid halides, preferably chlorides. One or more of the monocarboxylic acids may be used. Preferred unsaturated monocarboxylic fatty acids are oleic, linoleic, linolenic and palmitoleic acids, and their acid halides. Most preferred unsaturated monocarboxylic fatty acids are oleic and linoleic acids, and their acid halides.

The saturated monocarboxylic fatty acids used to prepare the ketene dimer and multimer compounds used in this invention preferably have 10–26 carbon atoms, more preferably 14–22 carbon atoms, and most preferably 16–18 carbon atoms. These acids include, for example, stearic, isostearic, myristic, palmitic, margaric, pentadecanoic, decanoic, undecanoic, dodecanoic, tridecanoic, nonadecanoic, arachidic and behenic acids, and their halides, preferably chlorides. One or more of the saturated monocarboxylic fatty acids may be used. Preferred acids are palmitic and stearic.

The alkyl dicarboxylic acids used to prepare the ketene multimer compounds for use in this invention preferably have 6–44 carbon atoms, and more preferably 9–10, 22 or 36 carbon atoms. Such dicarboxylic acids include, for example, sebacic, azelaic, 1,10-dodecanedioic, suberic, brazylic, docosanedioic acids, and $C_{36}$ dimer acids, e.g. EMPOL 1008 available from Henkel-Emery, Cincinnati, Ohio, U.S.A, and their halides, preferably chlorides. One or more of these dicarboxylic acids can be used. Dicarboxylic acids with 9–10 carbon atoms are more preferred. The most preferred dicarboxylic acids are sebacic and azelaic acids.

When dicarboxylic acids are used in the preparation of the ketene multimers for use in this invention, the maximum mole ratio of dicarboxylic acid to monocarboxylic acid (the sum of both saturated and unsaturated) is preferably about 5. A more preferred maximum is about 4, and the most preferred maximum is about 2. The mixture of dimer and multimer compounds may be prepared using methods known for the preparation of standard ketene dimers. In the first step, acid halides, preferably, acid chlorides, are formed from a mixture of fatty acids, or a mixture of fatty acids and dicarboxylic acid, using $PCl_3$ or another halogenating, preferably chlorinating, agent. The acid halides are then converted to ketenes in the presence of tertiary amines (including trialkyl amines and cyclic alkyl amines), preferably triethylamine. The ketene moieties then dimerize to form the desired compounds.

Ketene dimers and multimers not solid at 25° C. are disclosed in U.S. Pat. No. 5,685,815, U.S. patent application Ser. No. 08/428,288, filed Apr. 25, 1995, and U.S. Pat. No. 5,846,663, all of which are incorporated herein by reference in their entireties. Ketene dimers not solid at 25° C. are available as Precis® sizing agents, also from Hercules Incorporated.

Also included in the group of cellulose reactive sizes are alkenylsuccinic anhydrides (ASA). ASA's are composed of unsaturated hydrocarbon chains containing pendant succinic anhydride groups. They are usually made in a two-step process starting with alpha olefin. The olefin is first isomerized by randomly moving the double bond from the alpha position. In the second step the isomerized olefin is reacted with maleic anhydride to give the final ASA of formula 2. Typical olefins used for the reaction with maleic anhydride include alkenyl, cycloalkenyl and aralkenyl compounds containing from about 8 to about 22 carbon atoms. Specific examples are isooctadecenyl succinic anhydride, n-octadecenyl succinic anhydride, n-hexadecenyl succinic anhydride, n-dodecyl succinic anhydride, i-dodecenyl succinic anhydride, n-decenyl succinic anhydride and n-octenyl succinic anhydride.

(2)

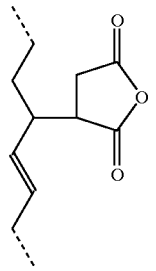

Alkenylsuccinic anhydrides are disclosed in U.S. Pat. No. 4,040,900, which is incorporated herein by reference in its entirety, and by C. E. Farley and R. B. Wasser in *The Sizing of Paper*, Second Edition, edited by W. F. Reynolds, Tappi Press, 1989, pages 51–62. A variety of alkenylsuccinic anhydrides is commercially available from Albemarle Corporation, Baton Rouge, La. Alkenylsuccinic anhydrides for use in the invention are preferably liquid at 25° C. More preferably they are liquid at20° C.

Preferred cellulose reactive sizes for use in the invention are ketene dimers and multimers of structure 1. More preferred cellulose reactive sizes are ketene dimers and multimers that are not solid at 25° C. (not substantially crystalline, semi-crystalline or waxy solid; i.e., they flow on heating without heat of fusion). Even more preferably they are not solid at 20° C., yet more preferably liquid at 25° C.; and most preferably liquid at 20° C.

The cellulose non-reactive sizes are polymeric materials having a molecular weight greater than about 1,500. Preferably the molecular weight is greater than about 5,000, and more preferably greater than about 10,000.

The polymeric cellulose non-reactive sizes for use in the invention may be subdivided into two groups: (1) those that are insoluble in water at pH less than about 6, and soluble at a pH above 6, and (2) those insoluble in water at pH's greater than about 6 and preferably having a primary glass transition temperature ($T_G$) of less than about 100° C. when blended neat with the cellulose reactive size of the size composition. More preferably the primary $T_G$ of the neat cellulose reactive/cellulose non-reactive size blend is less than about 60° C. and most preferably less than about 40° C. "Primary glass transition temperature" is the glass transition temperature corresponding to the highest heat capacity change observed during determination of $T_G$.

The water-soluble polymers of group (1) are preferably anionic polymers and are made from at least one monomer containing at least one carboxyl group. These polymers include copolymers of styrene or substituted styrenes with vinyl monomers containing carboxyl groups. Examples of such monomers include, but are not restricted to maleic anhydride, acrylic acid, methacrylic acid and itaconic acid. Also included are the partially esterified forms of such copolymers. Preferred water-soluble polymers of group (1) are styrene/maleic anhydride resins and their partially esterified counterparts. Examples of water-soluble polymeric cellulose non-reactive sizes for use in the invention are styrene/maleic anhydride resins, available as Scripset® resins from Hercules Incorporated, Wilmington Del., and Cypress®210, a poly(styrene/acrylic acid) resin, available from Cytec Industries, West Paterson, N.J.

The class of water-insoluble polymers includes, but is not limited to, copolymers of styrene or substituted styrenes with vinyl monomers. Examples of such vinyl monomers include, but are not restricted to maleic anhydride, acrylic acid or its alkyl esters, methacrylic acid or its alkyl esters, itaconic acid, divinyl benzene, acrylamide, acrylonitrile, cyclopentadiene and mixtures thereof. Also included are polyurethanes and copolymers of ethylene with comonomers such as vinyl acetate, acrylic acid and methacrylic acid.

Preferred water-insoluble polymers are copolymers made from monomers comprising styrene or substituted styrene, alkyl acrylate or methacrylate and ethylenically unsaturated carboxylic acid, where the styrene or substituted styrene is selected from the group consisting of styrene, α-methylstyrene, vinyl toluene and mixtures thereof, where the alkyl group of the alkyl acrylate or methacrylate contains from 1 to about 12 carbon atoms and where the ethylenically unsaturated carboxylic acid is selected from the group consisting of acrylic acid, methacrylic acid, maleic acid or anhydride, fumaric acid, itaconic acid and mixtures thereof. These copolymers are described in copending patent application Ser. No. 08/847,841 filed Apr. 28, 1997, which is incorporated herein by reference in its entirety. A preferred example of these copolymers is Chromaset®600 surface sizing treatment, available from Hercules Incorporated, Wilmington Del. Examples of other commercially available water-insoluble polymers are: Carboset®1086, a poly (styrene/acrylic acid/2-ethylhexyl acrylate) latex, available from B.F. Goodrich Co., Akron, Ohio; Basoplast®250D, a latex of poly(acrylonitrile/butyl acrylate), available from BASF Corporation, Charlotte, N.C.; Jetsize®Plus, a cationic poly(styrene/acrylate) latex, available from Eka-Nobel, Marietta, Ga.; Flexbond®381, poly(ethylene/vinyl acetate) latex, available from Air Products Corporation, Allentown, Pa,; and Flexbond®325, poly(ethylene/vinyl acetate) latex, available from Air Products Corporation.

The cellulose reactive sizes and the water-insoluble cellulose non-reactive sizes will generally be used as aqueous emulsions or dispersions. Cellulose non-reactive sizes that are insoluble at pH less than about 6 and soluble at a pH above 6 may be used in aqueous solution at the pH at which they are soluble, or they may be used as aqueous dispersions at lower pH's where they are not soluble in water.

Aqueous size compositions wherein both size components are present as aqueous dispersions may be prepared by mixing dispersions of the separate components, or alternatively, dispersing cellulose reactive size into a dispersion of cellulose non-reactive size. Mixing dispersions of the two components is the preferred method. The mixing may take place at the size press by adding separate dispersion components to the size press, or it may take place prior to use at the size press hours, or even days before use. In this regard, it is an advantage of the invention that the premixed dispersions have good storage stability, e.g. no substantial separation or formation of solids, and maintain their ability to be used for sizing for greater than eight days at room temperature. Preferably the premixed dispersions have good storage stability for greater than about 20 days, more preferably greater than about 60 days and most preferably greater than about 180 days.

The aqueous pulp suspension of step (a) of the process is obtained by means well known in the art, such as known mechanical, chemical and semichemical, etc., pulping processes. Normally, after the mechanical grinding and/or chemical pulping step, the pulp is washed to remove residual pulping chemicals and solubilized wood components. Either bleached or unbleached pulp fiber may be utilized in the process of this invention. Recycled pulp fibers are also suitable for use.

The sheeting and drying of the pulp suspension is also carried out by methods well known in the art. There is a variety of materials which in the commercial practice of making paper are commonly add to the aqueous pulp suspension before it is converted into paper, and may be used in the instant process as well. These include, but are not restricted to, wet strength resins, internal sizes, dry strength resins, retention aids, alum, fillers, pigments and dyes.

Paper sized by processes of this invention is commonly known as surface sized paper. Preferably, in surface sizing processes, the size is applied to the surface of the paper from a size press, which can be any type of coating or spraying equipment, but most commonly is a puddle, gate roller or metered blade type of size press.

Paper coatings are also applied to the surface of paper, but they are completely different in function and composition from surface sizes. Paper coating compositions have much higher viscosities than surface size compositions, and thus cannot readily be applied by a size press on a typical paper machine. Paper coatings contain pigment at levels 3 to 20 times higher than that of polymeric binder; whereas in a typical surface size pigments are optional. Preferably, they are used at levels of 0 to about 50% by weight, more preferably 0 to 30% by weight of the total solids level of the aqueous size composition.

For the sizing processes of the invention, the sizing composition is preferably mixed with a solution of starch or starch derivative prior to its application to the paper. The starch may be of any type, including but not limited to oxidized, ethylated, cationic and pearl starch, and is preferably used in aqueous solution.

The typical size press starch solution preferably contains a minimum of about 1% by weight starch in water, with a pH between about 6 and 9. A more preferable minimum starch level is about 2%, and the most preferable about 3%. The preferred maximum level of starch in the size composition is about 20% by weight. A more preferable maximum is about 16% and the most preferable about 12% by weight. Small amounts of other additives may be present as well, e.g., optical brighteners and defoamers. The amount of size composition added to the starch solution to form the size press compound is such that the minimum total of cellulose reactive and cellulose non-reactive size solids level in the final size press compound is preferably about 0.01 wt. % based on the total weight of the size composition. A more preferable minimum is about 0.02 wt. %. The preferred maximum total of cellulose reactive and cellulose non-reactive size solids level in the final size press compound is preferably about 2 wt. % and more preferably about 1 wt. %.

The ratio, on a dry basis, of cellulose non-reactive size to cellulose reactive size in the aqueous size compositions preferably has a minimum value of about 0.2:1. More preferably the minimum is about 0.5:1, and most preferably about 1:1. The maximum ratio is preferably about 50:1, more preferably about 40:1 and most preferably about 30:1.

The amount of surface size applied at the size press is such as to provide starch at a preferable minimum level of about 1 wt. % on a dry basis based on the dry weight of the paper. A more preferable minimum level is about 2 wt. %, and a most preferable minimum level about 3 wt. %. The maximum level of starch applied is preferably about 8 wt. %, more preferably about 7 wt. % and most preferably about 6 wt. % on a dry basis based on the dry weight of the paper.

Preferably the surface size is applied at the size press in an amount to provide a minimum amount of size composition, i.e. total of non-cellulose and cellulose reactive sizes, of about 0.01 wt. % on a dry basis based on the dry weight of the paper. A more preferable minimum amount is about 0.03 wt. %, and a most preferable minimum amount about 0.05 wt. %. Preferably the maximum amount of size composition will be about 1 wt. %, more preferably about 0.7 wt. % and most preferably about 0.5 wt. % on a dry basis based on the dry weight of the paper.

The amount of surface size applied will also provide a minimum amount of cellulose reactive size of about 0.005 wt. % on a dry basis based on the dry weight of the paper. A more preferable minimum amount is about 0.01 wt. %, and a most preferable minimum amount is about 0.02 wt. %. Preferably the maximum amount of cellulose reactive size applied is about 0.5 wt. %, more preferably about 0.3 wt. %, and most preferably about 0.2 wt. % on a dry basis based on the dry weight of the paper.

The amount of surface size applied will also provide a minimum amount of cellulose non-reactive size of about 0.01 wt. % on a dry basis based on the dry weight of the paper. A more preferable minimum amount is about 0.02 wt. %, and a most preferable minimum amount is about 0.04 wt. %. Preferably the maximum amount of cellulose non-reactive size applied is about 0.5 wt. %, more preferably about 0.4 wt. %, and most preferably about 0.3 wt. % on a dry basis based on the dry weight of the paper.

After application of the surface size, the sheets are dried utilizing any of the conventional drying procedures well known in the art.

One advantage of the processes of this invention is that internal sizing is not needed. However in some situations it is desirable to internally size, because internal sizing helps prevent the surface size from soaking into the sheet, thus allowing it to remain on the surface where it has maximum effectiveness. The paper to be surface sized by the processes of this invention may also be internally sized by addition of sizing agents to the pulp suspension before it is converted to a paper sheet.

The internal sizing agents encompass any of those commonly used at the wet end of a fine paper machine. These include rosin sizes, fortified rosin sizes, ketene dimers and multimers, and alkenylsuccinic anhydrides. The cellulose reactive and cellulose non-reactive sizes disclosed herein may also be used for internal sizing. The internal sizes are preferably used at levels of from about 0.05 wt. % to about 0.3 wt. % on a dry basis based on the weight of the dry paper sheet. More preferable levels are from about 0.01 to about 0.2 wt. %, and the most preferable levels from about 0.01 to about 0.1 wt. %.

Methods and materials utilized for internal sizing with rosin are discussed by E. Strazdins in *The Sizing of Paper*, Second Edition, edited by W. F. Reynolds, Tappi Press, 1989, pages 1–33.

Suitable ketene dimers and multimers, and alkenylsuccinic anhydrides for internal sizing are the same as those discussed above in connection with cellulose reactive sizes.

Another benefit of the invention is that paper produced by the processes of the invention has unique properties not obtained by using either cellulose reactive or cellulose non-reactive sizes alone. In general these properties combine the high efficiency of reactive sizes with improved toner adhesion, ability to use the paper in high speed converting or reprographic operations, good balance of color and black ink jet printing, no size reversion, and no reduction of coefficient of friction as is often associated with cellulose reactive sizes.

Specifically, the sized paper of this invention performs better in ink jet printing than does paper that is the same except that the size composition contains only cellulose reactive size, when the printing is evaluated for at least one property selected from the group consisting of optical density, feathering, wicking, edge roughness and bleed. The sized paper also has a higher coefficient of friction and a lower coefficient of friction bandwidth than does paper that is the same except that the size composition contains only cellulose reactive size. Bandwidth is defined as the difference between the average maximum and average minimum of the stick-slip response in the kinetic coefficient of friction curve.

When the surface sized paper of this invention is to be used for ink jet printing it has been found that the quality of the ink jet printing is enhanced by including in the surface size composition various salts of cationic metal ions that are soluble in water at about pH 7 to about pH 9. Examples of salts which are effective for this use are sodium chloride, sodium sulfate, calcium chloride, calcium bromide, magnesium chloride, magnesium bromide, aluminum sulfate and poly aluminum chloride. Preferred salts are calcium chloride, calcium bromide, magnesium chloride and magnesium bromide. More preferred salts are calcium and magnesium chlorides. The weight ratio of the salt to other solids contained in the size composition is from about 1:20 to about 20:1. More preferably the ratios are about 1:5 to about 5:1, and most preferably about 1:3 to about 3:1.

The paper of this invention is also capable of performing effectively in tests that measure its convertibility on state-of-the-art converting equipment and its performance on high speed end-use machinery. In particular, the paper according to the invention that can be made into folded continuous forms bond having a basis weight of about 30 to 60 lb/3000 $ft^2$ (48.7 to 95.5 $g/m^2$), preferably about 40 to 50 lb/3000 $ft^2$ (64.5 to 81.0 $g/m^2$), is capable of running on an IBM Model 3800 high speed, continuous-forms laser printer without causing billowing in the cooling section (after the fuser section and before the take-up section) of greater than about 5 inches (12.7 cm), preferably 3 inches (7.6 cm) or less, after ten minutes running time.

Further, the preferred paper according to the invention, that can be made into sheets of 8 ½×11 inch (21.6 cm×28 cm) reprographic cut paper having a basis weight of about 15–24 lb/1300 $ft^2$ (56.1 to 90.0 $g/m^2$) is capable of running on a IBM model 3825 high-speed copier without causing misfeeds or jams at a rate of 5 or less in 10,000, preferably at a rate of 1 or less in 10,000. By comparison, paper sized with standard alkyl ketene dimer has a much higher rate of double feeds on the IBM 3825 high speed copier (14 double feeds in 14,250 sheets). In conventional copy-machine operation, 10 double feeds in 10,000 is unacceptable. A machine manufacturer considers 1 double feed in 10,000 sheets to be unacceptable.

The paper of this invention in the form of a roll of continuous forms bond paper having a basis weight of about 20–24 lb/3000 $m^2$ (32.6 to 39.1 $g/m^2$) can be converted to a standard perforated continuous form on a Hamilton-Stevens continuous forms press at a press speed of at least about 1775 feet (541 m) per minute, preferably at least about 1900 feet (579 m) per minute.

The paper of this invention can also be made into a roll of envelope paper having a basis weight of about 20–24 lb/1300 $ft^2$ (75.2 to 90.1 $g/m^2$) that can be converted into at least about 900 envelopes per minute, preferably at least about 1000 per minute on a Winkler & Dunnebier CH envelope folder.

The paper of this invention can be run at a speed of at least about 58 sheets per minute on a high speed IBM 3825 sheet-fed copier with less than 1 in 10,000 double feeds or jams.

This invention is illustrated by the following examples, which are exemplary only and not intended to be limiting. All percentages, parts, etc., are by weight, based on the weight of the dry pulp, unless otherwise indicated.

Procedures

For all of the examples below, the paper used for sizing was prepared in advance, stored, and then treated on a laboratory puddle size press with the materials described. In all cases the base paper had no treatment applied at the size press during its manufacture. The application of materials at the size press consisted of dissolving starch in water by stirring and heating to about 95° C. for at least 30 minutes The starch solution was then kept at 65° C. until used, usually within a few hours. In some cases, sodium chloride (up to about 0.7 wt. %) was added. Sodium chloride is a typical additive in paper mill size presses, where it is used to increase the paper conductivity and therefore reduce static charge build-up. The starch solution pH was adjusted to about pH 8 before use, and then the size press additives were added to the starch. In some cases, as noted below, the pH was readjusted at this point. The materials were mixed for a few minutes and then added to the nip of two rollers on the puddle size press.

The untreated paper was fed through the rollers one time to apply the solution in the nip to the paper. The amount of solution applied to the paper by a specific starch solution under specific conditions was determined and used to set the level of additives in the starch solution to give the desired level of paper treatment.

Immediately following the application of the size press composition, the papers were dried on a drum dryer heated at 93–105° C. The papers were then conditioned and tested.

Hercules Size Test: The Hercules Size Test, an art-recognized test for measuring sizing performance, is described in *Pulp and Paper Chemistry and Chemical Technology*, J. P. Casey, Ed., Vol. 3, p. 1553–1554 (1981) and in TAPPI Standard T530. The Hercules Size Test determines the degree of water sizing obtained in paper by measuring the change in reflectance of the paper's surface as an aqueous solution of dye penetrates from the opposite surface side. The aqueous dye solution, e.g., naphthol green dye in 1% formic acid, is contained in a ring on the top surface of the paper, and the change in reflectance is measured photoelectrically from the bottom surface.

Test duration is limited by choosing a convenient end point, e.g., a reduction in reflected light of 20%, corresponding to 80% reflectance. A timer measures the time (in seconds) for the end point of the test to be reached. Longer times correlate with increased sizing performance, i.e., resistance to water penetration increases.

Ink Jet Printing Evaluation: Ink jet printing was tested with a Hewlett Packard Deskjet 560C printer. A Hewlett Packard 3.4 test pattern and method were used to rate the quality of the printing.

Before testing the paper was conditioned at 23° C. and 50% relative humidity for a minimum of one (1) day.

A. Evaluation of Black Ink Print Quality

Optical Density—An optical densitometer was placed over the black test rectangle on the printed sheet, and the optical density for black was recorded. This was repeated on different areas of the rectangle for a total of 6 readings.

Black Ink Spread (Feathering)—Black ink spread is the tendency for the ink to spread out from the print area. Using the magnifier, areas of the test pattern consisting of rows of the letter "E" were examined and the print quality was compared with standard examples of acceptable, good and unacceptable feathering. Specific areas that were examined were: degree of rounding of the square ends of the letter; amount of separation between the center stroke and the right ends of the letter, general breadth of the lines, etc. Similar inspection of line growth was made using the vertical and horizontal black lines in the test pattern.

Black Edge Roughness (Wicking)—Black edge roughness or wicking is the tendency for the ink to bleed away from the print area along a fiber or one direction, causing rough edges, even long "spidery" lines on the periphery of the print area. Using the magnifier, all areas of the test pattern where black lines are printed against a white background were examined and compared with the standard examples of acceptable, good and unacceptable wicking.

B. Evaluation of Color Print Quality

Optical Density—The optical densitometer was positioned over the composite black rectangle on the printed sheet, and the black optical density number was recorded. The composite black print consisted of a combination of cyan, magenta and yellow inks. The procedure was repeated on different areas of the rectangle for a total of 6 readings which were averaged and reported as composite black optical density.

Color -Color Edge Roughness—Color-color edge roughness measures the roughness of lines in areas where two colors overlap. Areas of the test pattern where composite black and yellow areas overlap were examined with a magnifier and compared with standard examples to judge whether the print quality was acceptable, good or unacceptable.

Color-Color Line Growth—Color-color line growth examines the size of printed features of one color touching or overlapping another color versus the intended size. A magnifier was used to examine the overlapping color text areas of the test pattern and to compare them with standard examples as acceptable, good or non-acceptable. Specifically, the size of composite black characters on a yellow background and yellow characters on a black background were examined.

Toner Adhesion: Relative toner adhesion is the relative amount of white paper showing through a solid black area of toner, applied by a copy machine, that results from the paper being creased. For the test, the paper was creased in a controlled fashion (toner on the inside of the crease), was unfolded, and then the loose toner was removed in a reproducible manner. The percentage of the crack area from which toner was lost was estimated by microscopic or optical density measurement of the crack and surrounding areas of toner, and reported as the toner adhesion value. Thus, a smaller value means that less toner is lost thus indicating greater toner adhesion.

Converting Test: In order to establish whether a sizing agent contributes to difficulties in converting operations, paper was made on a pilot paper machine, converted into forms, and then printed on an IBM 3800 high speed printer. The runnability on the IBM 3800 was used as a measure of converting performance. Specifically, the height to which the paper billows between two defined rolls on the IBM 3800 was used to quantify converting performance. The faster and higher the sheet billows, the worse the converting performance.

Materials

Cellulose non-reactive sizes Chromaset™600, surface sizing treatment: a poly(styrene/acrylic acid/acrylate ester) latex available from Hercules Incorporated, Wilmington, Del.

Carboset®1086: a poly(styrene/acrylic acid/2-ethylhexyl acrylate) latex, available from B.F. Goodrich Co., Akron, Ohio.

Scripset®740 sizing agent: an ammonium hydroxide based solution of an esterified poly(styrene/maleic anhydride), available from Hercules Incorporated, Wilmington, Del.

Basoplast®250D and Basoplast®335D: latexes of poly (acrylonitrile/acrylate ester), available from BASF Corporation, Charlotte, N.C.

Cypress®210: a high pH solution of a poly(styrene/acrylic acid)resin, available from Cytec Industries, West Paterson, N.J.

Jetsize®Plus: a cationic poly(styrene/acrylate) latex, available from Eka-Nobel, Marietta, Ga.

Flexbond®381: poly(ethylene/vinyl acetate) latex, available from Air Products Corporation, Allentown, Pa.

Flexbond®325: poly(ethylene/vinyl acetate) latex, available from Air Products Corporation, Allentown, Pa.

Cellulose Reactive Sizes

Precis®2000 sizing agent: an aqueous emulsion of an alkenyl ketene dimer, liquid at 25° C., from Hercules Incorporated, Wilmington, Del.

Hercon®70sizing agent: an aqueous dispersion of alkyl ketene dimer, solid at 25° C., available from Hercules Incorporated, Wilmington, Del.

EXAMPLE 1

This example illustrates mixing of cellulose reactive and cellulose non-reactive sizes at the size press followed by use of the mixture to treat unsized base sheet.

The cellulose reactive size was Precis®2000and the cellulose non-reactive size Chromaset™600.

The starch solution prepared contained 4% starch (D150 from Grain Processing Corporation, Muscatine, Iowa), 0.65% sodium chloride and the levels of cellulose and cellulose non-reactive sizes noted below in Table 1. The pH of the final mixture was adjusted to between 7.5 and 8, and it was applied to paper by the procedures described above. The paper was made at a basis weight of 75 g per $m^2$ from pulp consisting of 75% hardwood and 25% softwood refined to 425 CSF. It contained 10% precipitated calcium carbonate filler, Albacar®HO, from Specialty Minerals Inc., Bethlehem, Pa., 0.5% Sta-Lok®400 cationic starch, from A.E. Staley Manufacturing Co., Decatur, Ill, and 0.25% alum all of which were added internally during the preparation of the paper.

After treatment with the surface sizing composition, the paper was dried at 93° C. on a drum dryer to less than 5% moisture and allowed to age and condition for at least 5 days prior to evaluation. The sizing was measured by the Hercules Size Test using 80% reflectance and pH 2 ink. The results are presented in Table 1.

TABLE 1

| | Wt. % in Paper, Dry Basis | | |
|---|---|---|---|
| Example | Cellulose Reactive Size | Cellulose Non-Reactive Size | HST Sizing, seconds |
| 1A | 0.017 | 0 | <1 |
| 1B | 0.033 | 0 | <1 |
| 1C | 0 | 0.25 | 64 |
| 1D | 0.012 | 0.25 | 211 |
| 1E | 0.025 | 0.25 | 227 |

These results demonstrate the unexpectedly large increase in sizing that occurs by adding small amounts of Precis®2000 to Chromaset®600, when compared to the sizing achieved with Chromaset®600 alone, or Precis®2000 alone.

EXAMPLE 2

This example illustrates mixing of cellulose reactive and cellulose non-reactive sizes at the size press followed by use of the mixture to treat unsized base sheet at the size press.

The cellulose reactive size was Hercon®70 and the cellulose non-reactive size Carboset®1086.

The starch solution prepared contained 8% starch (Ethylex®2025 from Staley Manufacturing Co., Decatur, Ill.) and the levels of cellulose and cellulose non-reactive sizes noted below in Table 2. The pH of the final mixture was adjusted to between 7.5 and 8, and it was applied to paper by the procedures described above. The paper was made at a basis weight of 65 g per $m^2$ from pulp consisting of 70% hardwood and 30% softwood refined to 390 cfs. It contained 15% precipitated calcium carbonate filler (Albacar HO), 0.5% Sta-Lok®400 cationic starch, 0.1% alum and 0.15% Precis®2000 sizing agent, all of which were added internally . After treatment with the surface sizing composition, the paper was dried at 104° C. on a drum dryer to less than 3% moisture and allowed to age and condition for at least 1 day prior to evaluation. The sizing was measured by the Hercules Size Test using 80% reflectance and pH 2 ink. The results are presented in Table 2.

TABLE 2

| | Wt. % in Paper, Dry Basis | | |
|---|---|---|---|
| Example | Cellulose Reactive Size | Cellulose Non-Reactive Size | HST Sizing, seconds |
| 2A | 0 | 0 | 4 |
| 2B | 0 | 0.18 | 27 |
| 2C | 0.008 | 0.18 | 33 |
| 2D | 0.016 | 0.18 | 38 |

These data indicate that combinations of Carboset®1086 and Hercon®70 give higher levels of sizing than does Carboset®1086 alone.

The paper obtained in Examples 2A–2D was also evaluated for the quality of black ink jet printing obtained with the Hewlett Packard Deskjet 560C printer by the procedures described above.

Table 3 presents four ratings used to rate black and color print quality as specified by Hewlett Packard.

TABLE 3

| | INK JET PRINTING | | | |
|---|---|---|---|---|
| Example | Black Feather | Black Wick | Color-Color Roughness | Color-Color Line Growth |
| 2A | f | p | g | f–g |
| 2B | f–g | f | g | f–g |
| 2C | g | g | g | f–g |
| 2D | g | g | g | f–g |

p = poor or unacceptable
f = fair or acceptable
g = good
f–g = between fair and good The data in Table 3 indicate that the use of Hercono®70 with Carboset®1086 improved the print quality when compared to that obtained with Carboset®1086 alone.

EXAMPLE 3

This example illustrates mixing of cellulose reactive and water-soluble cellulose non-reactive sizes at the size press followed by use of the mixture to treat unsized base sheet at the puddle size press.

The cellulose reactive size was Hercon®70 and the cellulose non-reactive size Scripset®740, an ammonium hydroxide solution of an esterified poly(styrene/maleic anhydride).

The same conditions and procedures were followed as those in Example 2. The data are presented in Table 4.

TABLE 4

| | Wt. % in Paper, Dry Basis | | |
|---|---|---|---|
| Example | Cellulose Reactive Size | Cellulose Non-Reactive Size | HST Sizing, seconds |
| 3A | 0 | 0 | 4 |
| 3B | 0 | 0.082 | 39 |
| 3C | 0.004 | 0.082 | 43 |
| 3D | 0.008 | 0.082 | 47 |

These data indicate that Scripset®740 and Hercon®70 gave a higher level of sizing that did the Scripset®740 alone.

EXAMPLE 4

This example illustrates sizing using Precis®2000 cellulose reactive size with a variety of polymeric cellulose non-reactive sizes.

The conditions and procedures were the same as those used for Example 1, except that the sodium chloride level in the starch solution was 0.3% instead of 0.65%. The results are in Table 5.

TABLE 5

| | Wt. % in Paper, Dry Basis | | | |
|---|---|---|---|---|
| Exp. | Cellulose Non-Reactive Size | Cellulose Reactive Size | Cellulose Non-Reactive Size | HST Sizing, seconds |
| 4A | None | 0.012 | 0 | <1 |
| 4B | Basoplast ®250D | 0 | 0.25 | 394 |
| 4C | Basoplast ®250D | 0.012 | 0.25 | 416 |
| 4D | Cypress ®210 | 0 | 0.25 | 329 |
| 4E | Cypress ®210 | 0.012 | 0.25 | 410 |
| 4F | Jetsize ® Plus | 0 | 0.25 | 215 |
| 4G | Jetsize ® Plus | 0.012 | 0.25 | 256 |

These results demonstrate the unexpectedly large increase in sizing that occurs by adding small amounts of Precis®2000 to the various non-reactive sizes, when compared to the sizing achieved with the non-reactive sizes alone, or with Precis®2000 alone, and further demonstrate that the invention is operable with a variety of polymeric cellulose non-reactive paper sizes.

EXAMPLE 5

This example is a comparative example utilizing a polymeric material that is not a surface size when used over a base sheet containing no internal size.

The conditions and procedures were the same as those in Example 1, except that the sodium chloride level in the starch solution was 0.3% instead of 0.65%. The cellulose reactive size was Precis®2000 and the polymeric material was Flexbond®381, a poly(ethylene/vinyl acetate) polymer. When the Flexbond®381 was present on the paper at the 0.25% level with no Precis®2000, the HST sizing was 1 sec. When the Flexbond®381 was present on the paper at the 0.25% level together with 0.025% Precis®2000, the HST sizing remained at 1 sec, thus demonstrating no measured improvement in sizing. Precis®2000 alone at the 0.025% level yielded paper that exhibited sizing of less than 1 sec in the HST test.

EXAMPLE 6

This example shows that the cellulose reactive and cellulose non-reactive sizes can be premixed before addition to the size press. As in Example 3, Carboset®1086 and Scripset®740 cellulose non-reactive sizes were used in combination with Hercon®70 reactive size. However, rather than mixing into the starch solution just prior to sizing as in Examples 2 and 3, the materials were premixed at least 24 hours before use. All other conditions are the same as in Examples 2 and 3. The results are in Table 6.

TABLE 6

| | Wt. % in Paper, Dry Basis | | | |
|---|---|---|---|---|
| Exp. | Cellulose Non-Reactive Size | Cellulose Reactive Size, Hercon ®70 | Cellulose Non-Reactive Size | HST Sizing, seconds |
| 7A | Carboset ®1086 | 0 | 0 | 4 |
| 7B | Carboset ®1086 | 0 | 0.18 | 27 |
| 7C | Carboset ®1086 | 0.008 | 0.18 | 32 |
| 7D | Carboset ®1086 | 0.016 | 0.18 | 38 |
| 7E | Scripset ®740 | 0 | 0.18 | 39 |

TABLE 6-continued

| Exp. | Cellulose Non-Reactive Size | Wt. % in Paper, Dry Basis: Cellulose Reactive Size, Hercon ®70 | Wt. % in Paper, Dry Basis: Cellulose Non-Reactive Size | HST Sizing, seconds |
|---|---|---|---|---|
| 7F | Scripset ®740 | 0.008 | 0.18 | 39 |
| 7G | Scripset ®740 | 0.016 | 0.18 | 41 |

The data indicate that combinations of Carboset®1086 and Precis®2000 when premixed gave more sizing than Carboset added alone. The combination of Scripset®740 with Precis®2000, however, was not effective when premixed. Example 3 indicates that they were effective when mixed at the size press.

EXAMPLE 7

This example illustrates the effect of the combination of cellulose reactive and cellulose non-reactive sizes in overcoming the detrimental effect on coefficient of friction (COF) of cellulose reactive size alone.

The paper base sheet was made from a 70/30 hardwood/softwood mixture, and contained 0.15% alkyl ketene dimer (Hercon®76 from Hercules Incorporated, Wilmington, Del.) and 12% calcium carbonate filler added internally.

The cellulose reactive size was Hercon®70 and the cellulose non-reactive size was Chromaset®600. The surface size compound contained D150 starch, and was used at a level such that starch was added to the base sheet at a level of 3.2 wt. % on a dry basis.

The results are presented in Table 7.

TABLE 7

| Exp. | Wt. % in Paper, Dry Basis: Cellulose Reactive Size | Wt. % in Paper, Dry Basis: Cellulose Non-Reactive Size | Coefficient of Friction: Static | Coefficient of Friction: Kinetic | Coefficient of Friction: Bandwidth |
|---|---|---|---|---|---|
| 7A | 0 | 0 | 0.676 | 0.507 | 0.182 |
| 7B | 0.050 | 0 | 0.651 | 0.476 | 0.169 |
| 7C | 0 | 0.15 | 0.637 | 0.493 | 0.147 |
| 7D | 0.050 | 0.15 | 0.673 | 0.523 | 0.150 |

The data in Table 7 indicate that the use of Hercon®70 alone for surface sizing lowered COF, while the combination of Hercon®70 and Chromaset®600 yielded a higher COF than did Hercon®70 or Chromaset®600 alone. The relatively low bandwidth observed with the size combination is also advantageous, because higher bandwidths are associated with causing paper misfeeds and jams in high speed reprographic equipment.

EXAMPLE 8

This example illustrates preparation of the size composition by mixing dispersions of cellulose reactive and cellulose non-reactive sizes, and demonstrates the stability of the resulting dispersion for greater than 8 days, i.e., no substantial separation or formation of solids, and maintenance of the ability to size.

Precis®2000 sizing agent, an aqueous dispersion of alkenyl ketene dimer, was mixed with polymer dispersion Basoplast®335D to form a dispersion sizing composition. Two different blending ratios were utilized. "Premix 1" contained a 3:1 ratio of Basoplast®335D to Precis®2000 on a dry solids basis, and "Premix 2" contained a 10:1 ratio of Basoplast®335D to Precis®2000 on a dry solids basis.

The premixes were allowed to age at room temperature and then examined for separation or formation of solids and tested for sizing paper at specified times as listed in Table 8. The paper was sized as described in Example 1 with the exception that in this case the base sheet contained 15% Albacar®HO precipitated calcium carbonate filler.

For all of the aging periods noted in Table 8, no separation or formation of solids was observed. The HST sizing data (utilizing pH 2 ink and 80% reflectance) are presented in Table 8.

TABLE 8

| Surface Additive | Premix Age (Days) | Wt. % on Paper, Dry Basis | HST Sizing (Seconds) |
|---|---|---|---|
| Premix 1 | 1 | 0.16 | 5 |
| " | " | 0.22 | 15 |
| Premix 2 | " | 0.20 | 8 |
| " | " | 0.40 | 49 |
| Premix 1 | 7 | 0.20 | 8 |
| " | " | 0.40 | 79 |
| Premix 2 | " | 0.20 | 6 |
| " | " | 0.40 | 78 |
| Premix 1 | 20 | 0.16 | 3 |
| " | " | 0.22 | 10 |
| " | " | 0.40 | 46 |
| Premix 2 | " | 0.20 | 3 |
| " | " | 0.40 | 31 |

The data in Table 8 indicate that acceptable sizing occurred with sizes that were aged for 20 days.

EXAMPLE 9

This example illustrates the use of calcium chloride dissolved in the surface size composition for surface sizing paper, and the effect of the calcium chloride in enhancing the black optical density of ink jet printing applied to the surface sized paper.

The base paper sheet was prepared from a 75:25 bleached hardwood:softwood pulp mixture beat to 425 CSF and contained internally 10% AlbacarHO precipitated calcium carbonate, 0.05% alkenyl succinic anhydride sizing agent, 0.75% Sta-Lok®400 cationic starch and 0.25% alum.

The paper was surface sized with size compositions containing: a) starch only; b) starch and Printrite®594 polymer latex (available from B. F. Goodrich Co., Akron, Ohio), the polymer contained in the latex having a primary TG of less than 100° C.; c) starch, Precis®2000 sizing agent, Printrite®594 polymer latex and calcium chloride; and d) starch, Precis®2000 sizing agent and Printrite®594 polymer latex In all cases the starch was present at a level of 8 wt. %. The levels of calcium chloride, Precis®2000 sizing agent and Printrite®594 polymer (all on a dry basis) are presented in Table 9 below. The size compositions were used in the size press to treat the paper, the levels materials added to the starch being adjusted based on the amount of the starch solution picked up by the paper. The paper was evaluated for sizing by the Hercules Sizing Test using 80% relectance and pH 2 ink, and for black jet printing by the method provided above.

The results are presented in Table 9.

TABLE 9

| Weight % in Paper, Dry Basis | | | | Black |
|---|---|---|---|---|
| Precis ®2000 | Calcium Chloride | Printrite ®594 | HST Sizing, secs | Optical Density |
| 0 | 0 | 0 | 2 | 1.29 |
| 0.017 | 0 | 0.133 | 83 | 1.54 |
| 0 | 0 | 0.15 | 48 | 1.36 |
| 0.017 | 0.15 | 0.133 | 74 | 1.70 |

The results in the table indicate that adding calcium chloride to the sizing composition containing both cellulose reactive and cellulose non-reactive sizes appreciably enhances the ink jet printing performance of the sized paper.

It is not intended that the examples presented here should be construed to limit the invention, but rather they are submitted to illustrate some of the specific embodiments of the invention. Various modifications and variations of the present invention can be made without departing from the scope of the appended claims.

What is claimed is:

1. A process for preparing sized paper comprising:

a) providing an aqueous pulp suspension;

b) sheeting and drying the aqueous pulp suspension to obtain paper;

c) applying to the paper an aqueous size composition comprising at least one cellulose reactive size that is not solid at 25° C. and at least one cellulose non-reactive size that is a polymer of weight average molecular weight greater than about 1,500, wherein the aqueous size composition is prepared by mixing an aqueous dispersion of cellulose reactive size and an aqueous dispersion or aqueous solution of cellulose non-reactive size, and has a shelf life at room temperature of greater than about 8 days without substantial separation or formation of solids; and d) drying the paper.

2. The process of claim 1 wherein the aqueous size composition further comprises pigment at a level of from 0 to about 50% by weight of the total solids level of the aqueous size composition.

3. The process of claim 1 wherein the aqueous size composition further comprises pigment at a level of from 0 to about 30% by weight of the total solids level of the aqueous size composition.

4. The process of claim 1 wherein the cellulose reactive size is not solid at 20° C.

5. The process of claim 1 wherein the cellulose reactive size is liquid at 25° C.

6. The process of claim 1 wherein the cellulose reactive size is liquid at 20° C.

7. The process of claim 1 wherein the cellulose reactive size not solid at 25° C. is selected from the group consisting of ketene dimers, ketene multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

8. The process of claim 1 wherein the cellulose reactive size comprises alkenylsuccinic anhydride.

9. The process of claim 1 wherein wherein the cellulose reactive size comprises ketene dimer or multimer not solid at 25° C. that is a mixture of compounds having the structure:

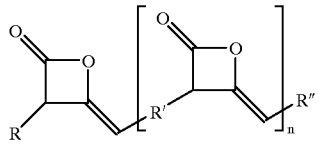

wherein n is an integer of 0 to about 20, R and R", which may be the same or different, are saturated or unsaturated straight chain or branched alkyl groups having 6 to 24 carbon atoms; and R' is a saturated or unsaturated straight chain or branched alkyl group having from about 2 to about 40 carbon atoms, and wherein at least 25% of the R and R" groups is unsaturated.

10. The process of claim 9 wherein R and R" have from 10 to 20 carbon atoms and R' has from 4 to 8 or from 28 to 40 carbon atoms.

11. The process of claim 9 wherein R and R" have from 14 to 16 carbon atoms and R' has from 4 to 8 or from 28 to 40 carbon atoms.

12. The process of claim 1 wherein the cellulose non-reactive size has a weight average molecular weight greater than about 5,000.

13. The process of claim 1 wherein the cellulose non-reactive size has a weight average molecular weight greater than 10,000.

14. The process of claim 1 wherein the cellulose non-reactive size is selected from the group consisting of: (a) polymers insoluble in water at pH less than about 6 and soluble in water at a pH greater than 6, and (b) water-insoluble polymers having a primary $T_G$ of less than about 100° C. when blended with the cellulose reactive size of the size composition.

15. The process of claim 1 wherein the cellulose non-reactive size comprises water-insoluble polymer having a primary $T_G$ of less than about 100° C. when blended with the cellulose reactive size of the size composition.

16. The process of claim 1 wherein the cellulose non-reactive size comprises water-insoluble polymer having a primary $T_G$ of less than about 60° C. when blended with the cellulose reactive size of the size composition.

17. The process of claim 1 wherein the cellulose non-reactive size comprises water-insoluble polymer having a primary $T_G$ of less than about 40° C. when blended with the cellulose reactive size of the size composition.

18. The process of claim 1 wherein the cellulose non-reactive size is a water-insoluble polymer comprising copolymers of styrene or substituted styrenes with at least one monomer selected from the group consisting of maleic anhydride, acrylic acid, methacrylic acid, itaconic acid, acrylate esters, methacrylate esters, divinyl benzene, acrylamide, cyclopentadiene and acrylonitrile.

19. The process of claim 1 wherein the cellulose non-reactive size is a water-insoluble polymer comprising polyurethane polymers.

20. The process of claim 1 wherein the cellulose non-reactive size is a water-insoluble polymer comprising copolymers of ethylene with at least one monomer selected from the group consisting of vinyl acetate, acrylic acid and methacrylic acid.

21. The process of claim 1 wherein the cellulose non-reactive size is a water-insoluble copolymer made from monomers comprising styrene or substituted styrene, alkyl acrylate or methacrylate and ethylenically unsaturated carboxylic acid, wherein the styrene or substituted styrene is selected from the group consisting of styrene, α-methylstyrene, vinyl toluene and mixtures thereof, wherein the alkyl group of the alkyl acrylate or methacrylate contains from 1 to about 12 carbon atoms and wherein the ethylenically unsaturated carboxylic acid is selected from the group consisting of acrylic acid, methacrylic acid, maleic acid or anhydride, fumaric acid, itaconic acid and mixtures thereof.

22. The process of claim 21 wherein the copolymer has a primary $T_G$ of less than about 100° C. when blended with the cellulose reactive size of the size composition.

23. The process of claim 1 wherein the cellulose non-reactive size comprises a polymer insoluble in water at pH less than 6, but soluble at a pH greater than 6.

24. The process of claim 1 wherein the cellulose non-reactive size comprises a polymer insoluble in water at pH less than about 6 and soluble at a pH greater than 6, selected from the group consisting of anionic polymers, cationic polymers and amphoteric polymers.

25. The process of claim 1 wherein the cellulose non-reactive size comprises an anionic polymer insoluble in water at pH less than about 6, and soluble at a pH greater than 6.

26. The process of claim 25 wherein the anionic polymer insoluble in water at pH less than about 6 and soluble at a pH greater than 6 is copolymer made from monomers comprising at least one monomer containing a carboxyl group.

27. The process of claim 25 wherein the anionic polymer insoluble in water at pH less than about 6 and soluble at a pH greater than 6 comprises copolymers of styrene or substituted styrenes with monomers selected from the group consisting of maleic anhydride, acrylic acid, methacrylic acid and itaconic acid.

28. The process of claim 1 wherein the cellulose reactive size and the cellulose non-reactive size are both dispersed in water.

29. The process of claim 28 wherein the aqueous size composition is prepared by mixing aqueous dispersions of the cellulose reactive and the cellulose non-reactive sizes.

30. The process of claim 1 wherein the aqueous size composition is applied at a level such that the level of the cellulose non-reactive size applied is from about 0.04 to about 0.3 wt. % on a dry basis based on the weight of the dry paper.

31. The process of claim 1 wherein the aqueous dispersion is stable for greater than 20 days without substantial separation or formation of solids.

32. The process of claim 1 wherein the aqueous dispersion is stable for greater than 60 days without substantial separation or formation of solids.

33. The process of claim 1 wherein the aqueous dispersion is stable for greater than 180 days without substantial separation or formation of solids.

34. The process of claim 1 wherein the cellulose reactive size is a dispersion in aqueous medium, and the cellulose non-reactive size is in aqueous solution.

35. The process of claim 1 wherein the ratio on a dry basis of the cellulose non-reactive size to the cellulose reactive size in the size composition is about 0.2:1 to about 50:1.

36. The process of claim 1 wherein the ratio on a dry basis of the cellulose non-reactive size to the cellulose reactive size in the size composition is from about 0.5:1 to about 40:1.

37. The process of claim 1 wherein the ratio on a dry basis of the cellulose non-reactive size to the cellulose reactive size in the size composition is from about 1:1 to about 30:1.

38. The process of claim 1 wherein the aqueous size composition further comprises at least one water-soluble salt of a cationic metal ion, the salt being soluble in water at about pH 7 to about pH 9.

39. The process of claim 38 wherein the at least one water-soluble salt is selected from the group consisting of sodium chloride, sodium sulfate, calcium chloride, calcium bromide, magnesium chloride, magnesium bromide, aluminum sulfate and poly aluminum chloride.

40. The process of claim 38 wherein the at least one water-soluble salt is selected from the group consisting of calcium chloride, calcium bromide, magnesium chloride and magnesium bromide.

41. The process of claim 38 wherein the at least one water-soluble salt is selected from the group consisting of calcium chloride and magnesium chloride.

42. The process of claim 38 wherein the weight ratio of the at least one water-soluble salt to the other non-aqueous components of the size composition is from about 1:20 to about 20:1.

43. The process of claim 38 wherein the weight ratio of the at least one water-soluble salt to the other non-aqueous components of the size composition is from about 1:5 to about 5:1.

44. The process of claim 38 wherein the weight ratio of the at least one water-soluble salt to the other non-aqueous components of the size composition is from about 1:3 to about 3:1.

45. The process of claim 1 wherein the aqueous size composition further comprises starch.

46. The process of claim 45 wherein the starch in the aqueous size composition is at a level of about 1 wt. % to about 20 wt. % on a dry basis based on the total weight of the aqueous size composition.

47. The process of claim 45 wherein the starch in the aqueous size composition is at a level of about 2 wt. % to about 16 wt. % on a dry basis based on the total weight of the aqueous size composition.

48. The process of claim 45 wherein the starch in the aqueous size composition is at a level of about 3 wt. % to about 12 wt. % on a dry basis based on the total weight of the aqueous size composition.

49. The process of claim 45 wherein the size is applied at a level that provides about 1 wt. % to about 8 wt. % starch on a dry basis based on the dry weight of the paper.

50. The process of claim 45 wherein the size is applied at a level that provides about 2 wt. % to about 7 wt. % starch on a dry basis based on the dry weight of the paper.

51. The process of claim 45 wherein the size is applied at a level that provides about 3 wt. % to about 6 wt. % starch on a dry basis based on the dry weight of the paper.

52. The process of claim 1 wherein the total of the cellulose reactive and the cellulose non-reactive sizes in the aqueous size composition is at a level of from about 0.01 to about 2 wt. % on a dry basis based on the total weight of the aqueous size composition.

53. The process of claim 1 wherein the total of the cellulose reactive and the cellulose non-reactive sizes hf the aqueous size composition is at a level of from about 0.02 to about 0.1 wt. % on a dry basis based on the total weight of the aqueous size composition.

54. The process of claim 1 wherein the aqueous size composition is applied at a level that provides about 0.01 wt. % to about 1 wt. % total cellulose reactive and cellulose non-reactive sizes on a dry basis, based on the weight of the dry paper.

55. The process of claim 1 wherein the aqueous size composition is applied at a level that provides about 0.03 wt.

% to about 0.7 wt. % total cellulose reactive and cellulose non-reactive sizes on a dry basis, based on the weight of the dry paper.

56. The process of claim 1 wherein the aqueous size composition is applied at a level that provides about 0.05 wt. % to about 0.5 wt. % total cellulose reactive and cellulose non-reactive sizes on a dry basis, based on the weight of the dry paper.

57. The process of claim 1 wherein the aqueous size composition is applied at a level such that the level of the cellulose reactive size applied is from about 0.005 to about 0.5 wt. % on a dry basis based on the weight of the dry paper.

58. The process of claim 1 wherein the aqueous size composition is applied at a level such that the level of the cellulose reactive size applied is from about 0.01 to about 0.3 wt. % on a dry basis based on the weight of the dry paper.

59. The process of claim 1 wherein the aqueous size composition is applied at a level such that the level of the cellulose reactive size applied is from about 0.02 to about 0.2 wt. % on a dry basis based on the weight of the dry paper.

60. The process of claim 1 wherein the aqueous size composition is applied at a level such that the level of the cellulose non-reactive size applied is from about 0.01 to about 0.5 wt. % on a dry basis based on the weight of the dry paper.

61. The process of claim 1 wherein the aqueous size composition is applied at a level such that the level of the cellulose non-reactive size applied is from about 0.02 to about 0.4 wt. % on a dry basis based on the weight of the dry paper.

62. The process of claim 1 wherein the applying of step (c) takes place at a size press.

63. The process of claim 62 wherein the size press is a puddle size press.

64. The process of claim 62 wherein the size press is a gate roller size press.

65. The process of claim 62 wherein the size press is a metered blade size press.

66. The process of claim 62 wherein an aqueous dispersion of the cellulose reactive size and an aqueous dispersion or solution of the cellulose non-reactive size are mixed at the size press to form the size composition.

67. The process of claim 1 further comprising adding at least one size to the aqueous pulp suspension prior to step (b).

68. The process of claim 67 wherein the at least one size is selected from the group consisting of rosin size, fortified rosin size, ketene dimers, ketene multimers, and alkenylsuccinic anhydrides.

69. The process of claim 67 wherein the at least one size is added at a level of from about 0.01 wt. % to about 0.3 wt. % on a dry basis based on the weight of the dry paper.

70. The process of claim 67 wherein the at least one size is added at a level of from about 0.01 wt. % to about 0.2 wt. % on a dry basis based on the weight of the dry paper.

71. The process of claim 67 wherein the at least one size is added at a level of from about 0.01 wt. % to about 0.1 wt. % on a dry basis based on the weight of the dry paper.

72. The process of claim 1 wherein the at least one cellulose reactive size is selected from the group consisting of ketene dimers, ketene multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms, and the at least one cellulose non-reactive size is a water-insoluble copolymer of styrene or substituted styrene with at least one monomer selected from the group consisting of maleic anhydride, acrylic acid, methacrylic acid, itaconic acid, acrylate esters, methacrylate esters, divinyl benzene, acrylamide, cyclopentadiene and acrylonitrile.

73. The process of claim 72 wherein the neat blend of the cellulose reactive and the cellulose non-reactive sizes has a primary $T_G$ less than about 100° C.

74. The process of claim 72 wherein the aqueous size composition further comprises starch.

75. The process of claim 1 wherein the at least one cellulose reactive size is selected from the group consisting of ketene dimers, ketene multimers, alkenylsuccinic anhydrides, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms, and the at least one cellulose non-reactive size is a copolymer of ethylene with at least one monomer selected from the group consisting of vinyl acetate, acrylic acid and methacrylic acid.

76. The process of claim 75 wherein the neat blend of the cellulose reactive and the cellulose non-reactive sizes has a primary $T_G$ less than about 100° C.

77. The process of claim 75 wherein the aqueous size composition further comprises starch.

* * * * *